United States Patent [19]

Held

[11] Patent Number: 4,537,810

[45] Date of Patent: Aug. 27, 1985

[54] METALLIC ENDLESS PRESS BAND HAVING AN EMBOSSED SURFACE FOR USE IN DOUBLE BAND PRESSES IN THE MANUFACTURE OF LAMINATES

[76] Inventor: Kurt Held, Alte Str. 1, D-7218 Trossingen 2, Fed. Rep. of Germany

[21] Appl. No.: 561,636

[22] Filed: Dec. 15, 1983

[30] Foreign Application Priority Data

Dec. 21, 1982 [DE] Fed. Rep. of Germany ..... 3247145

[51] Int. Cl.[3] ..... B22D 11/06

[52] U.S. Cl. ..... 428/156; 164/154; 428/576; 428/600; 428/618; 428/674

[58] Field of Search ..... 164/154; 428/576, 600, 428/618, 674, 607, 156, 172; 420/494, 401

[56] References Cited

U.S. PATENT DOCUMENTS

| | | | |
|---|---|---|---|
| 1,898,487 | 2/1933 | Hurley | 420/494 X |
| 2,131,475 | 9/1938 | Hensel et al. | 420/494 |
| 2,172,639 | 9/1939 | Hessenbruch | 420/494 |
| 2,422,477 | 6/1947 | Driver | 420/494 X |
| 3,938,580 | 2/1976 | Donini | 165/154 |

FOREIGN PATENT DOCUMENTS

| | | | |
|---|---|---|---|
| 0955255 | 4/1964 | United Kingdom | 420/494 |

OTHER PUBLICATIONS

Donachie, Be-Cu, A Heat Treatable Alloy, Modern Metals, Jul. 1945.

Bery-Cu, Richards, Materials & Methods Manual, Bush Beryllium Co.

Donachie, Role of Be-Cu as an Eng. Mat.

Ludwigson et al., Heat Treatable Cu Alloys, Battelle Mem. Inst.

*Primary Examiner*—George F. Lesmes

*Assistant Examiner*—Nancy A. B. Swisher

*Attorney, Agent, or Firm*—Toren, McGeady, Stanger

[57] ABSTRACT

A metallic endless press band with an embossed engraving thereon for use in double band presses for the manufacture of laminates, such as panels, foils, films and the like having textured surfaces wherein a lengthwise and crosswise welding of rolled or electrodeposited surfaces is utilized, consisting essentially of a material which is a metal alloy which may be precipitation hardened or altered in its crystal structure by heat or radiation treatment, the metal structure at the welding seam being identical with the unwelded base material after hardening or after treatment to the extent that no hardness or crystal structure differences which impair the depth of the embossing pattern result when texturing the surface by knurling, etching or mechanical engraving.

1 Claim, 2 Drawing Figures

METALLIC ENDLESS PRESS BAND HAVING AN EMBOSSED SURFACE FOR USE IN DOUBLE BAND PRESSES IN THE MANUFACTURE OF LAMINATES

The present invention relates generally to endless press bands having embossed engravings therein for double band presses for the surface treatment of pressed laminates such as chip board, thermosetting and thermoplastic foils and films having textured surfaces, wherein the endless press band is joined by a welding seam.

In the manufacture of thermosetting pressed laminates, as well as of plastic coated hard fiber board, wood fiber board, wood chip board, fiberglass panels and the like, there has developed to an increasing degree a demand to form such items with surfaces having an embossed or textured pattern. The embossing of the pattern is normally accomplished by means of embossing tools.

Generally, for this purpose, there are utilized presses having metallic pressing sheets provided with an embossed engraving produced mainly by etching the pressing sheets. In continuously operating laminating machines, the laminates are pressed between two continuously traveling endless belts. In order to texture the panel surfaces, the press band surface must have a negative impression of the texture which is to be achieved. In order to produce such a textured or embossed press band, there may be applied an etching method such as is used for continuously operating machines. Since such endless bands must be welded together transversely or diagonally of the traveling direction thereof, the structure which appears at the welding seam is generally different from that of the remainder of the material of the band. This causes a welding seam to clearly appear after an etching process and thus it is embossed into the pressed laminate as a visible welding seam during their manufacture.

In the prior art, attempts have been made to avoid such difficulties by electroplating onto the endless band a metal layer and by subsequently etching thereinto the desired texture or embossing pattern. The depth of the etched engraving is less than the thickness of this metal layer and in this regard reference is made to German Pat. No. 29 50 795 C2. However, attendant disadvantages of such an approach are the extra work and accordingly increased costs which are caused by the electrodepositing of the metal layer.

A further disadvantage is that a worn surface may no longer be reworked since the danger then would exist that the electroplated metal layer would be penetrated thereby again exposing the welding seam which would again be impressed on the laminate to be manufactured.

Accordingly, it is an object of the present invention to provide an approach to simplifying the procedure of producing the surface texture of the embossing bands so that an electroplated metal layer is no longer necessary.

SUMMARY OF THE INVENTION

Briefly, the invention may be described as an improvement in the making of an endless metallic press band having an embossing pattern thereon particularly for use in double band presses for manufacture of laminates having textured surfaces, said endless band being formed with a transverse weld seam, the improvement comprising that the endless press band consists essentially of a metal alloy which can be precipitation hardened or altered in its crystal structure by heat or radiation treatment and that after hardening or after treatment the metal structure at the weld seam is identical with the unwelded base material to the extent that no hardness and crystal structure differences which might impair the textured depth will result when texturing the surface by knurling, etching or mechanical engraving.

The material which is used for the embossing band is a precipitation hardenable metal alloy such as beryllium-copper alloy, copper-cobalt-beryllium, copper-nickel-beryllium alloy and the like and the material, after welding to form the endless belt by a conventional method such as WIG, plasma, electron beam or laser welding is hardened to its final hardness by heat treatment during which the structure across the welding seam matches that of the rest of the material whereupon the etched engraving is then applied.

The procedures in accordance with the invention have the advantage that the welding compound and the zone thermally stressed by the welding is no different in structure than the rest of the metal and therefore there will be no different etching characteristics than the embossing band material when etching is effected. Therefore, the welding seam will no longer be produced on pressed laminates to be manufactured utilizing the press belt.

Another advantage of the invention is that an embossing band surface worn by use may be reworked or retreated by etching without the danger that the welding seam will thereafter again appear on the laminate.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE PREFERRED EMBODIMENT

Figure 1:
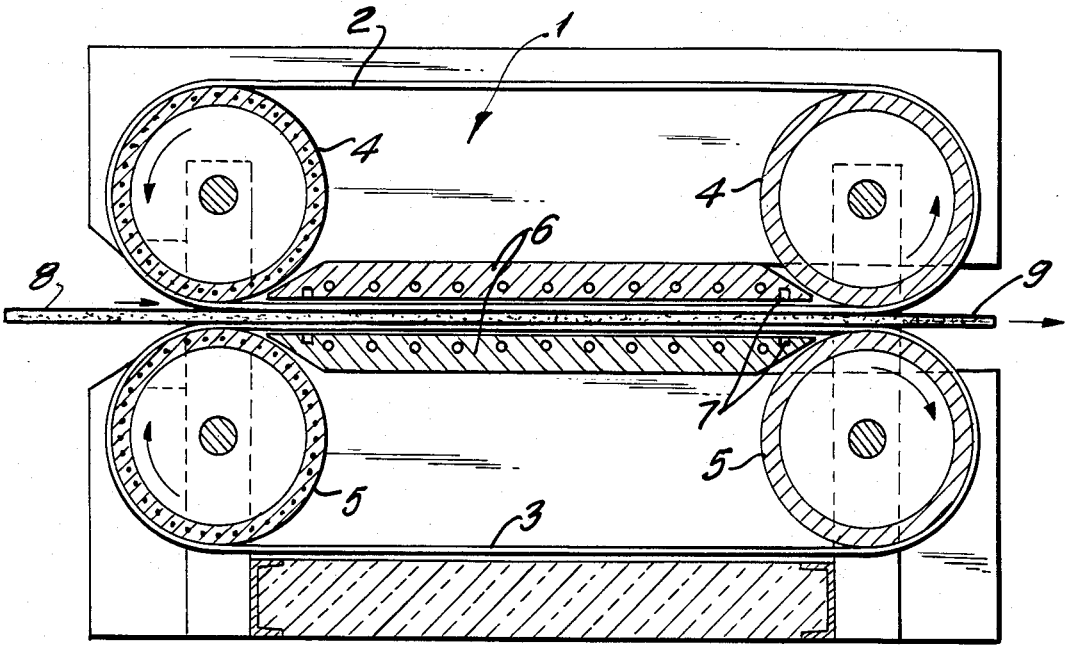
FIG. 1 is a sectional view showing a continuously operating laminating machine consisting of two endless bands.

Referring now to the drawing there is shown a laminating machine 1 which includes two endless bands or belts 2, 3 which are synchronously driven by two motors and which are each held tightly by a pair of rollers 4,5. The press bands 2,3 run across heating plate 6. Between the heating plate 6 and the endless bands 2,3 there are pressure pads which are laterally limited by seals 7, the counterpressure being adjusted by means of the pressure pads.

Instead of the pressure pads, support rollers may also be provided.

A laminate material or preproduct 8 is fed to the intake of the machine and the material 8 may comprise resin impregnated wood chip cake which is pressed into a laminate 9 between the endless belts which revolve in opposite directions.

The upper endless band 2 or the lower endless band 3, or both, are provided with a negative of a pattern to be embossed on the laminate and this may be an etched engraving which is impressed into the laminate surface during the production cycle thus generating the desired positive surface texture.

The endless bands 2,3 are between 700 and 2800 mm wide and from 0.5 to 2 mm thick.

Figure 2:
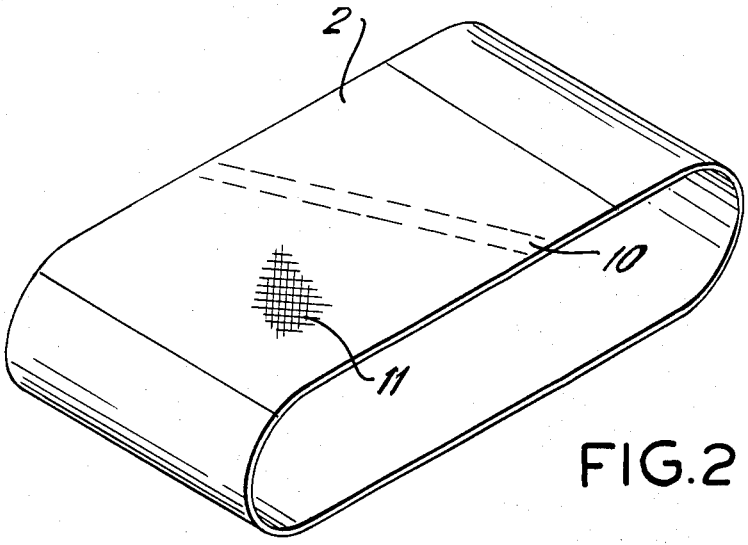
FIG. 2 is a perspective view showing one of the endless bands of FIG. 1.

As shown in FIG. 2, both ends of the bands are welded together either transversely or diagonally by a welding seam 10. The welding seam 10 is ground and polished.

The embossing band 2 consists of high tensile, precipitation hardenable metal alloy such as beryllium-copper alloy. The weld seam 10, due to the properties of the precipitation hardenable metal alloy, has the same structure as the rest of the band. A negative embossing pattern 11, which operates to produce the textured surface on the laminate 9, is worked into the surface of the embossing band 2. Many methods for forming this pattern are known as previously described herein.

After completion of the etched engraving and chrome plating, the endless band 2 will be ready for utilization in the laminating machine 1.

As previously indicated, the preferred materials for the embossing band are precipitation hardenable metal alloys such as beryllium-copper alloy, copper-cobalt-beryllium alloy, copper-nickel-beryllium alloy and the like. The endless belt may be formed after welding by conventional methods such as WIG, plasma, electron beam or laser welding. The belt is then hardened to its final hardness by heat treating during which the structure across the welding seam will match that of the base of the belt whereupon an etched engraving is then applied.

The material for the press band is selected to be an alloy which can be precipitation hardened by means of heat treatment such as malleable beryllium-copper alloys which are available in the market, for example, from Vacuumschmelze GmbH, Hanau, Germany (VAC) under the tradenames BERYVAC and DURATHERM. These materials are preferred because of their tensile strength after hardening. Any material which is already cold-work hardened may advantageously be selected in order thus to obtain maximum tensile strength after hardening as well as more rapid hardening.

After the band is welded into an endless configuration and the welding seam is ground and polished, the entire band is precipitation hardened if the band has not already been hardened completely prior to the welding operation. Alternatively, the welding seam area only may be hardened if the band material has already been hardened prior to welding by means of heat treatment and the temperature and duration of the hardening is determined by the metal alloy which is used. Then the etched engraving may be produced.

Virtually all known methods are suitable for this purpose and these include photographic reproduction methods, wherein a photosensitive layer is applied to the band surface which is subsequently exposed by means of a negative representation of the pattern and developed.

The areas remaining thereafter protect the band against the etching attack whereas the free areas are removed to the desired depth by the etching medium.

Other possible methods which may be used are, for example, the printing of etch resisting areas with printing rollers, the pattern spraying or suspending of such lacquers, or similar methods which permit patterned masking to protect against the attack of the etching medium or embossed etched engraving wherein the band surface is coated with a wax layer or a layer having similar properties into which a profiled roller may impress the pattern.

The band surface areas which are thus free of wax are attacked by an etching medium and removed to the desired depth. To avoid a visible beginning of the embossed pattern, the circumference of the embossing band should be equal to or be an integral multiple of the roller circumference. This profiling method makes it possible to obtain a multiple etching to achieve stepped etching depths which can serve to blur the beginning of the pattern by having the band revolve repeatedly.

While a specific embodiment of the invention has been shown and described in detail to illustrate the application of the inventive principles, it will be understood that the invention may be embodied otherwise without departing from such principles.

What is claimed is:

1. In an endless metallic press band having an embossing pattern thereon particularly for use in double band presses for the manufacture of laminates having textured surfaces, said endless band being formed with a transverse weld seam, the improvement comprising that said endless band consists essentially of a material which is a metal alloy wherein said metal alloy is selected from the group consisting of beryllium-copper alloy, copper-cobalt-beryllium alloy and copper-nickel-beryllium alloy, which can be precipitation hardened or altered in its crystal structure by heat or radiation treatment and that after hardening, or after treatment, the metal structure at the welding seam is identical with the unwelded base material to the extent that no hardness and crystal structure differences which might impair the texture depth result when texturing the surface by knurling, etching or mechanical engraving.

* * * * *